US007726960B2

(12) United States Patent
Oui et al.

(10) Patent No.: US 7,726,960 B2
(45) Date of Patent: Jun. 1, 2010

(54) TWIN-PLATE ROTARY COMPRESSOR

(75) Inventors: Kim Tiow Oui, Singapore (SG); Yung Liang Teh, Singapore (SG)

(73) Assignee: Nanyang Technological University, Singapore (SG)

( * ) Notice: Subject to any disclaimer, the term of this patent is extended or adjusted under 35 U.S.C. 154(b) by 567 days.

(21) Appl. No.: 11/628,440

(22) PCT Filed: Jun. 1, 2005

(86) PCT No.: PCT/SG2005/000173

§ 371 (c)(1),
(2), (4) Date: Dec. 4, 2006

(87) PCT Pub. No.: WO2005/119067

PCT Pub. Date: Dec. 15, 2005

(65) Prior Publication Data

US 2007/0207049 A1 Sep. 6, 2007

Related U.S. Application Data

(60) Provisional application No. 60/576,616, filed on Jun. 4, 2004.

(51) Int. Cl.
*F03C 2/00* (2006.01)
*F03C 4/00* (2006.01)
*F04C 18/00* (2006.01)

(52) U.S. Cl. ..... 418/193; 418/68; 418/140; 418/143; 418/195

(58) Field of Classification Search ..... 418/68, 418/140, 142, 143, 193, 195
See application file for complete search history.

(56) References Cited

U.S. PATENT DOCUMENTS

| | | | | |
|---|---|---|---|---|
| 763,963 | A | 7/1904 | Cobb | |
| 764,465 | A | 7/1904 | Hendricks | |
| 2,482,325 | A | 9/1949 | Davis | |
| 2,621,852 | A | 12/1952 | Pisa | |
| 3,040,664 | A | 6/1962 | Hartley | |
| 3,277,792 | A | 10/1966 | Stenerson | |
| 3,528,242 | A * | 9/1970 | Hartmann | 418/193 |
| 3,556,696 | A * | 1/1971 | Bertoni | 418/68 |
| 4,688,522 | A | 8/1987 | McMaster | |
| 4,799,870 | A | 1/1989 | McMaster | |
| 5,018,435 | A | 5/1991 | Kägi | |

FOREIGN PATENT DOCUMENTS

| | | | |
|---|---|---|---|
| DE | 2064429 | A | 1/1972 |

* cited by examiner

*Primary Examiner*—Theresa Trieu
(74) *Attorney, Agent, or Firm*—Carlson Gaskey & Olds PC

(57) ABSTRACT

This invention relates to a twin-plate, rotary compressor and refers particularly, though not exclusively, to a twin-plate, rotary compressor comprising two conical plates for relative rolling motion within a casing, there being a line contact between the two conical plates; the line contact being maintainable during operation of the compressor; a central seal for sealingly engaging correspondingly-shaped recesses of the two conical plates; and an outer seal in mating relationship with the two conical plates; wherein the central seal is mounted on a drive shaft, the drive shaft being operatively connected to an output shaft of a motor; wherein the drive shaft, the central seal and the outer seal are for rotation about a third axis of rotation, the third axis of rotation being coincident with a longitudinal axis of the drive shaft and a center of the central seal.

42 Claims, 17 Drawing Sheets

TWIN-PLATE ROTARY COMPRESSOR

REFERENCES TO RELATED APPLICATIONS

This application is a U.S. National Phase 35 U.S.C. §371 of PCT International Application No. PCT/SG05/00173 which has an International filing date of Jun. 1, 2005, designating the U.S., which claims priority to U.S. Provisional Application No. 60/576,616 filed on Jun. 4, 2004. The content of these applications are incorporated herein by reference in their entirety.

FIELD OF THE INVENTION

This invention relates to a twin-plate, rotary compressor and refers particularly, though not exclusively, to a positive displacement compressor which employs the relative rolling motion of two plates to achieve the compression and discharge of a working fluid.

BACKGROUND OF THE INVENTION

Reciprocating compressors have been used for a considerable time. However, it is well accepted that a reciprocating motion is not efficient, as the momentum of the piston must be reversed every half cycle.

Rotary compressors are known. However, as generally their rubbing components possess high relative velocities, frictional loss is high and therefore efficiency is somewhat limited.

SUMMARY OF THE INVENTION

In accordance with a first preferred aspect there is provided a rotary, twin-plate compressor comprising:

(a) two conical plates for relative rolling motion within a casing, there being a line contact between the two conical plates; and (b) the line contact being maintainable between the two conical plates during operation of the compressor.

The line contact may be maintained throughout the compressor's operational cycle. The line contact may be at a position relative to the casing that is either fixed, or rotating relative to the casing. The two conical plates may be truncated cones.

In accordance with a second preferred aspect there is provided a rotary twin-plate compressor comprising a first conical plate having a first axis of rotation, a second conical plate having a second axis of rotation, the first axis of rotation being offset at an offset angle relative to the second axis of rotation.

There may be further provided a central seal for sealingly engaging correspondingly-shaped recesses of the two conical plates. The central seal may be substantially spherical. The central seal comprises an inlet port at one end, and having at least one fluid passageway to operatively connect the inlet port to a working chamber. The working chamber may be an enclosed space defined by the central seal, the two conical plates, and an outer seal.

The outer seal may comprise an inner surface shaped as a segment of a sphere, each of the two conical plates having an outer surface of a shape to mate with the inner surface. The outer seal comprises an outlet port, the outlet port being an opening through the outer seal.

The inner seal may be mounted on a drive shaft, the drive shaft being operatively connected to an output shaft of a motor.

The compressor may further comprise a fluid block rigidly connected to the central seal and outer seal, and in sealing engagement to the two conical plates for rotation therewith.

For the first aspect, the two conical plates may comprise a first plate having a first axis of rotation and a second plate having a second axis of rotation, the first axis of rotation being offset at an offset angle relative to the second axis of rotation.

The offset angle may in the range 1 to 89 degrees, preferably less than 45 degrees, more preferably less than 20 degrees, and most preferably 7.5 degrees.

The two conical plates may be identical and each may comprise a conical angle, the conical angle determining the offset angle.

The drive shaft, fluid block and outer seal may be for rotation about a third axis of rotation, the third axis of rotation being coincident with a longitudinal axis of the drive shaft and a centre of the central seal.

The casing may be hermetically sealed and may comprise a hollow main body, and an end plate at each end of the hollow main body. The compressor may further comprise a discharge outlet in one of the end plates, the hollow main body having an interior at discharge pressure.

The central seal, outer seal and fluid block may comprise a drive assembly. Each of the two conical plates may be mounted on a bush, each bush being mounted on a bush support.

The compressor may further comprise lubricant passageways in the bush supports and the two conical plates.

The first plate may be stationary relative to the casing, and the second plate may have motion relative to the casing. The line contact may rotate relative to the casing.

The compressor may further comprise a third plate located between the first and second plates. The third plate may comprise two surfaces, one of which may form a first line contact with the first plate and the other of which may form a second line contact with the second plate. The first and second plates may be stationary and the third plate may be for a rolling motion relative to both the first and second plates.

Both of the two surfaces of the third plate may be concave and conical; the conical surfaces of the third plate having a conical angle different to that of the first plate and that of the second plate. The outer seal may be in rolling motion with the third plate.

According to a third preferred aspect, the compressor described above is used as a motor.

BRIEF DESCRIPTION OF THE DRAWINGS

In order that the present invention may be fully understood and readily put into practical effect, there shall now be described by way of non-limitative example only preferred embodiments of the present invention, the description being with reference to the accompanying illustrative drawings.

In the drawings.

DETAILED DESCRIPTION OF THE PREFERRED EMBODIMENTS

Figure 1:
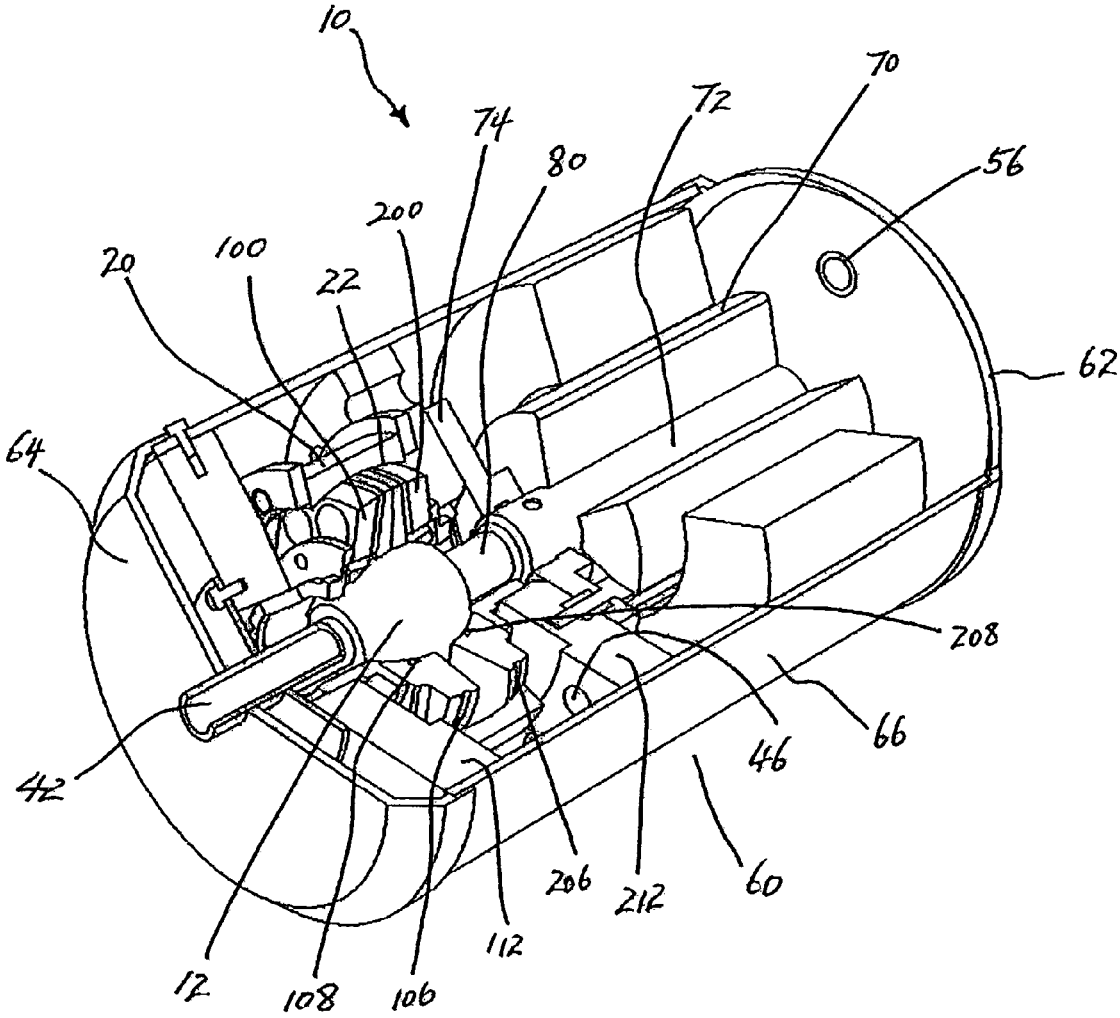
FIG. 1 is a front perspective view in partial cut-away of a first embodiment.
Figure 2:
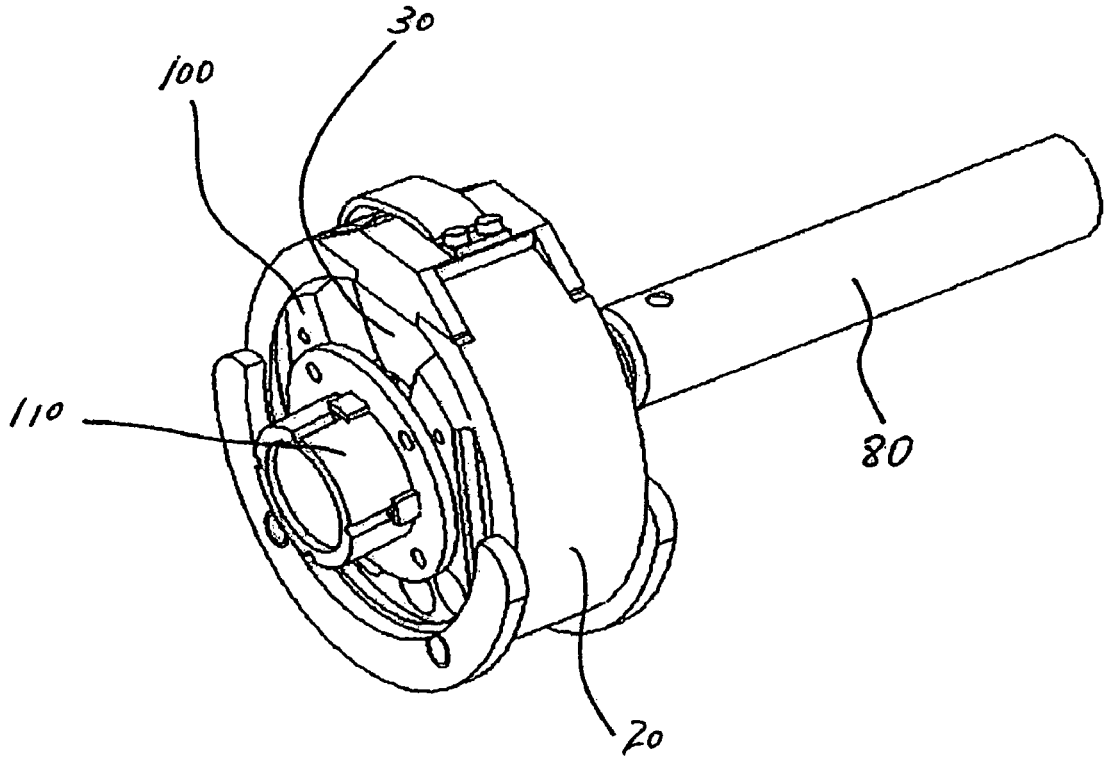
FIG. 2 is a front perspective view of the rotating assemblies of FIG. 1.
Figure 3:
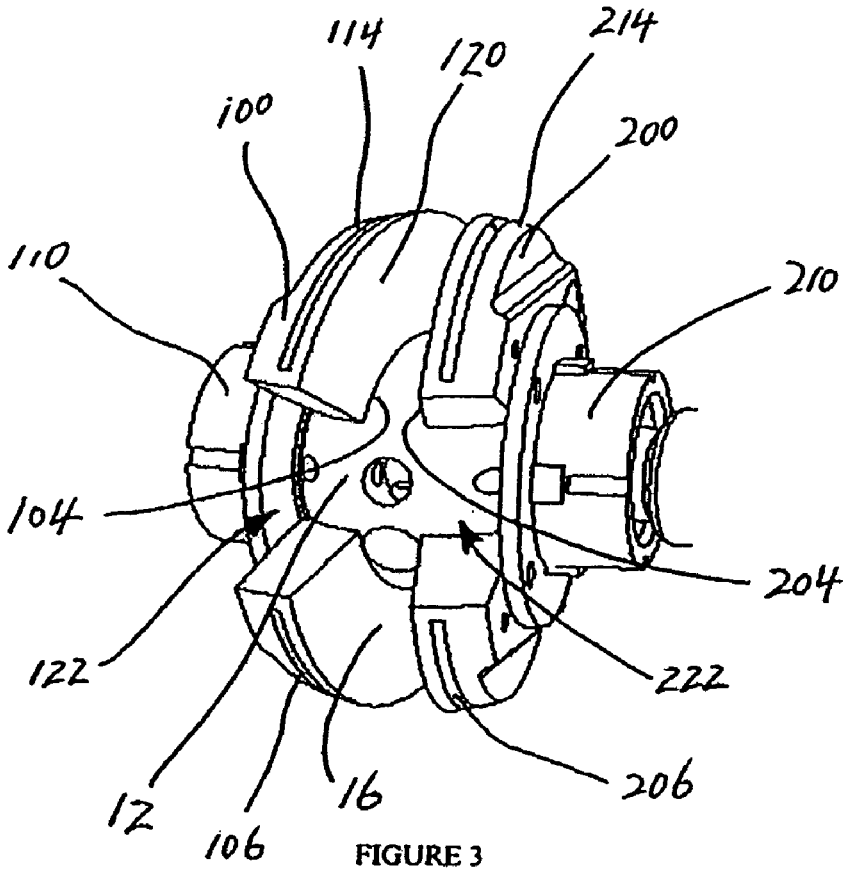
FIG. 3 is a front perspective view of the piston of FIGS. 1 and 2.

The rotary twin-plate compressor 10 comprises ten main components:

1. a first plate 100;
2. a second plate 200;
3. a central sphere 12;
4. an outer seal 20;
5. a fluid block 30;
6. an inlet port 40;
7. an outlet port 50;
8. a casing or shell 60;
9. a motor 70; and
10. a drive shaft 80.

The only motion governing the operation of the compressor 10 is rotation. The spherical centre of all components is the spherical centre of the central sphere 12.

Figure 4:
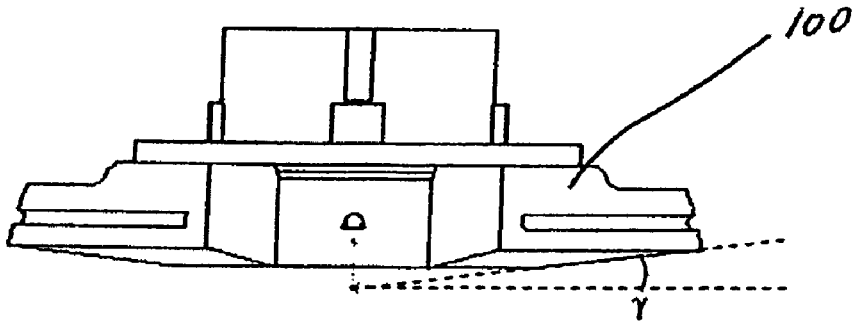
FIG. 4 is a schematic side representation of the plates function.
Figure 5:
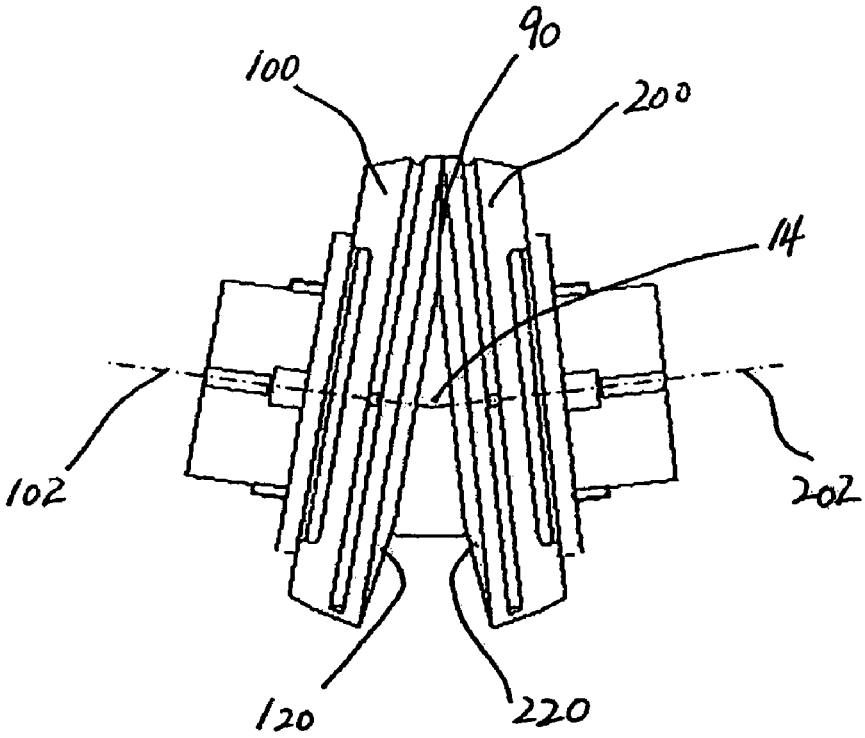
FIG. 5 is a schematic side view of the piston of FIG. 3.
Figure 6:
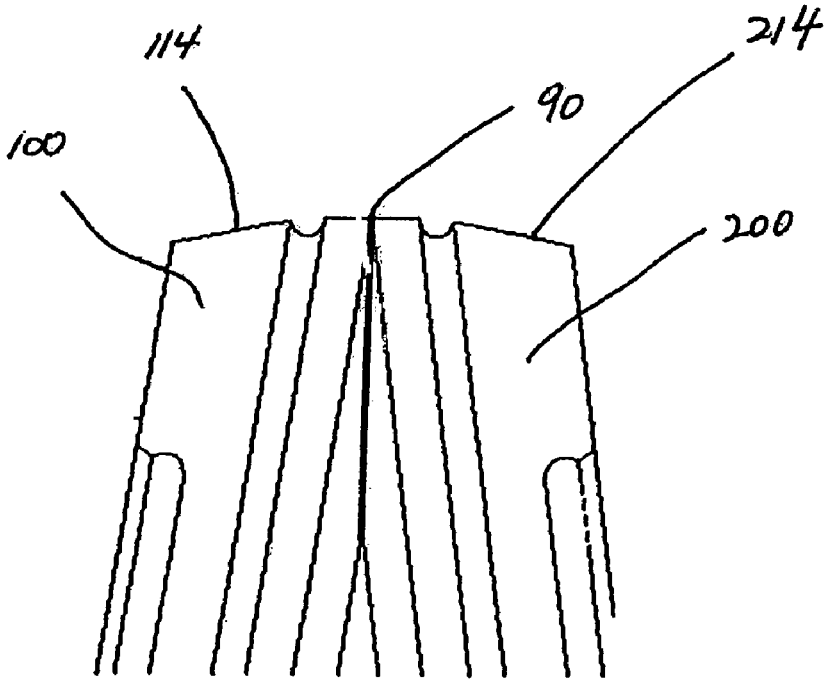
FIG. 6 is an enlarged view of the upper portion of FIG. 5 illustrating the rolling line contact.

The compressor 10 primarily consists of the two conical plates 100 and 200 that are preferably identical and truncated cones in shape. The two plates 100, 200 are positioned such that their axes of rotation 102 and 202 respectively are aligned at an offset angle 14. As the two plates 100, 200 rotate in the same direction, a rolling line contact 90 exists between them. The offset angle 14 of alignment of the two rotational axes depends on the value of the conical angle, $\gamma$ (FIG. 4). This is to maintain the line contact between the two plates 100 and 200. The offset angle 14 is in the range 1° to 89°, preferably less than 45°, more preferably is less than 20°, and most preferably is 7.5°.

Due to this offset angle 14, the line contact 90 is established by the conical surfaces 120, 220 of both plates 100, 200. As the respective symmetrical axes 102, 202 of the plates 100, 200 are their axes of rotation and as the two plates 100, 200 rotate in the same direction, the line contact 90 will be maintained during the operation of the compressor 10, and throughout the operating cycle of the compressor 10. In this embodiment the line contact 90 is at a fixed position relative to the casing 60. More specifically, relative to each plate 100, 200, the other plate will be rolling on it, thus making the line contact 90 a rolling contact.

If the conical angles $\gamma$ are the same, the rolling line contact 90 will be solely a rolling motion. If the conical angles $\gamma$ are different, the rolling line contact 90 will include a sliding motion, with the extent of the sliding motion being proportional to the difference in the conical angles $\gamma$.

The working volume 16 of compressor 10 is the space between the two plates 100, 200. It is hermetically sealed as the central sphere 12 acts as an inner seal of the working volume 16. The inner seal 12 formed by the central sphere 12 prevents the working fluid from escaping through the centre of the two plates 100, 200. In order to allow the rotation of the two plates 100, 200 and still maintain the sealing, the surfaces 104, 204 of the two plates 100, 200 that contact the central sphere 12 are concave and spherical.

Figure 7:
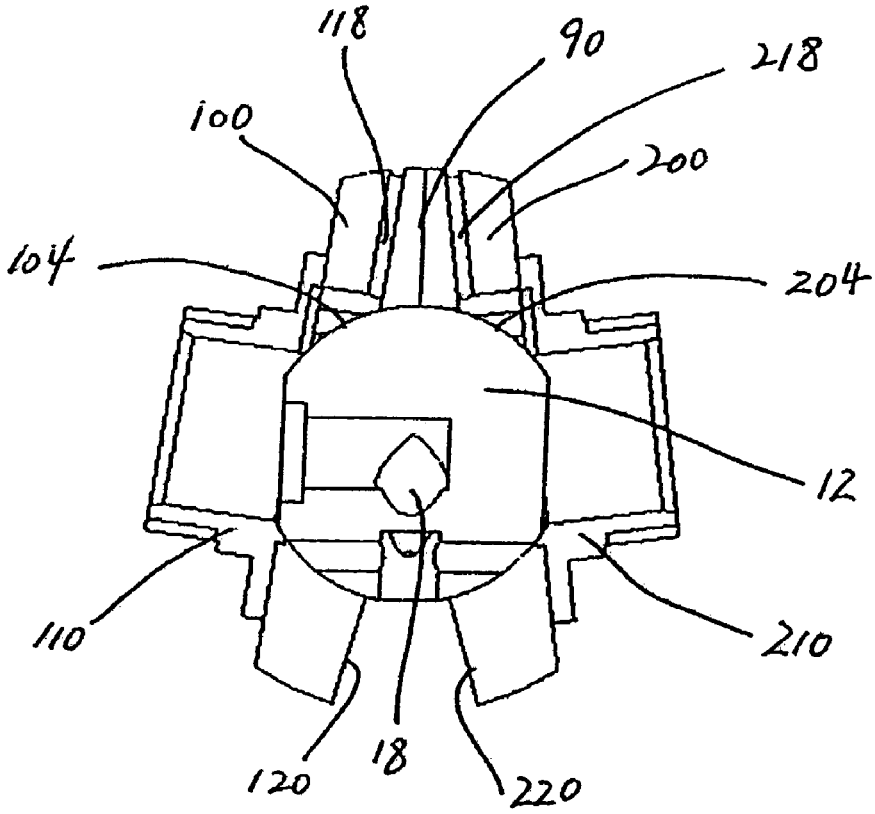
FIG. 7 is a vertical cross-sectional view of the piston of FIG. 3 showing the centre sphere.
Figure 8:
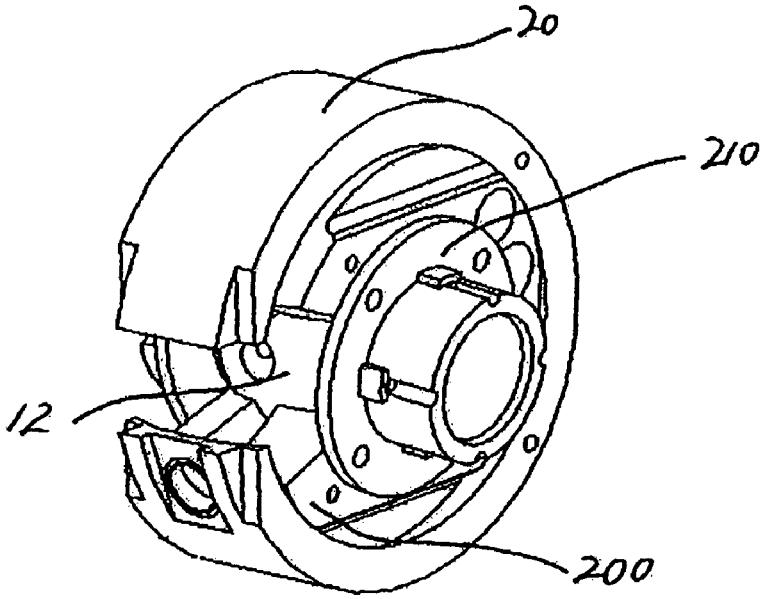
FIG. 8 is a perspective view of the piston of the FIG. 3 showing the outer seal.
Figure 9:
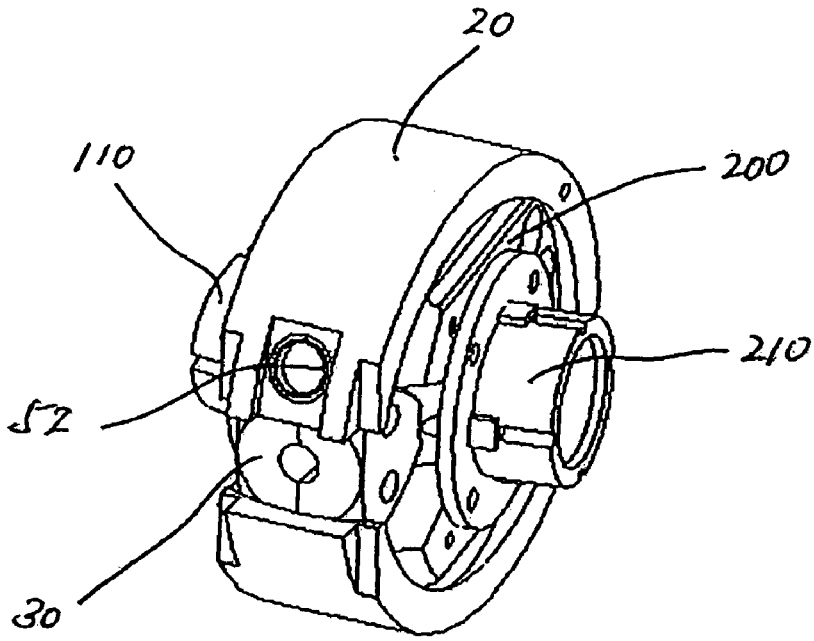
FIG. 9 is a front perspective view of the piston of FIG. 9 with the fluid block fitted.
Figure 10:
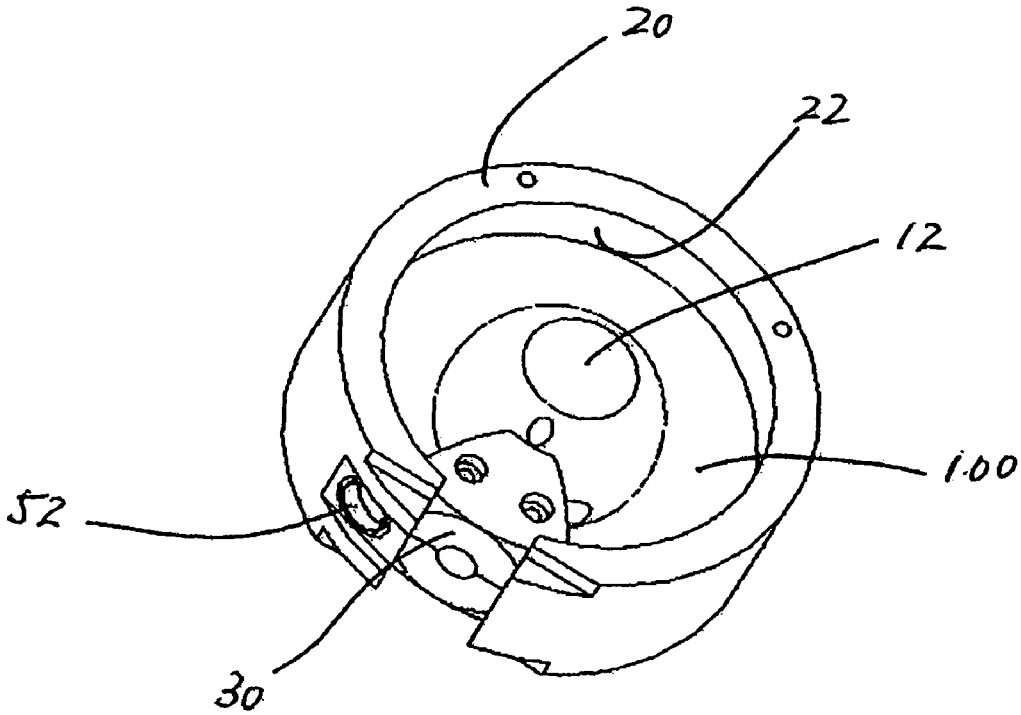
FIG. 10 is a rear perspective view corresponding to FIG. 9, with one plate hidden.
Figure 11:
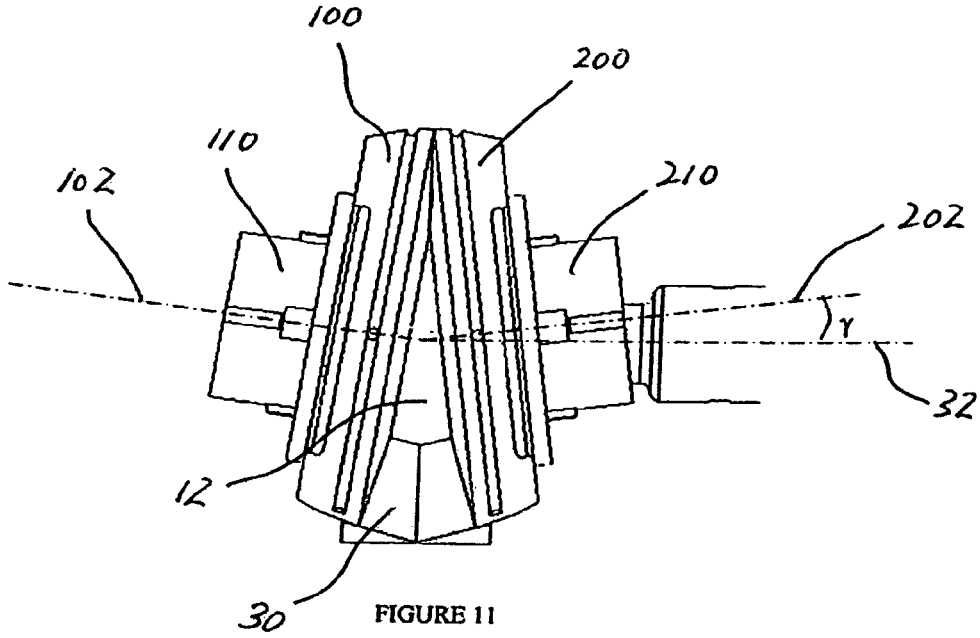
FIG. 11 is a schematic side view of the piston of FIGS. 9 and 10.
Figure 12:
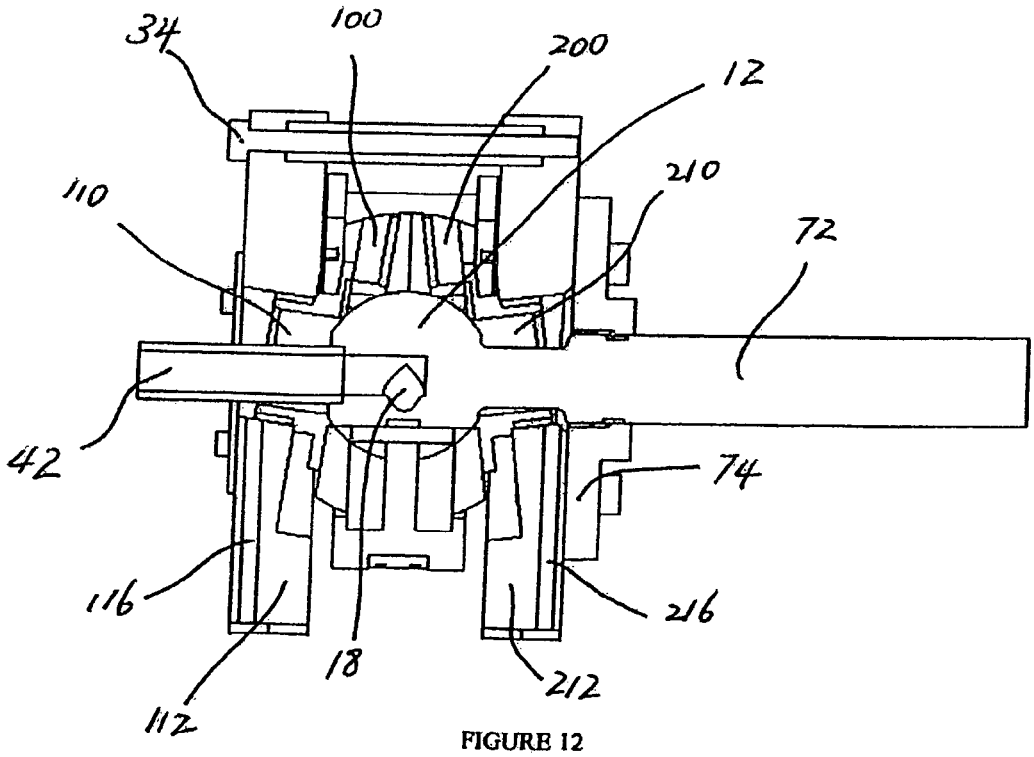
FIG. 12 is a vertical cross-sectional view of the driver assembly.
Figure 13:
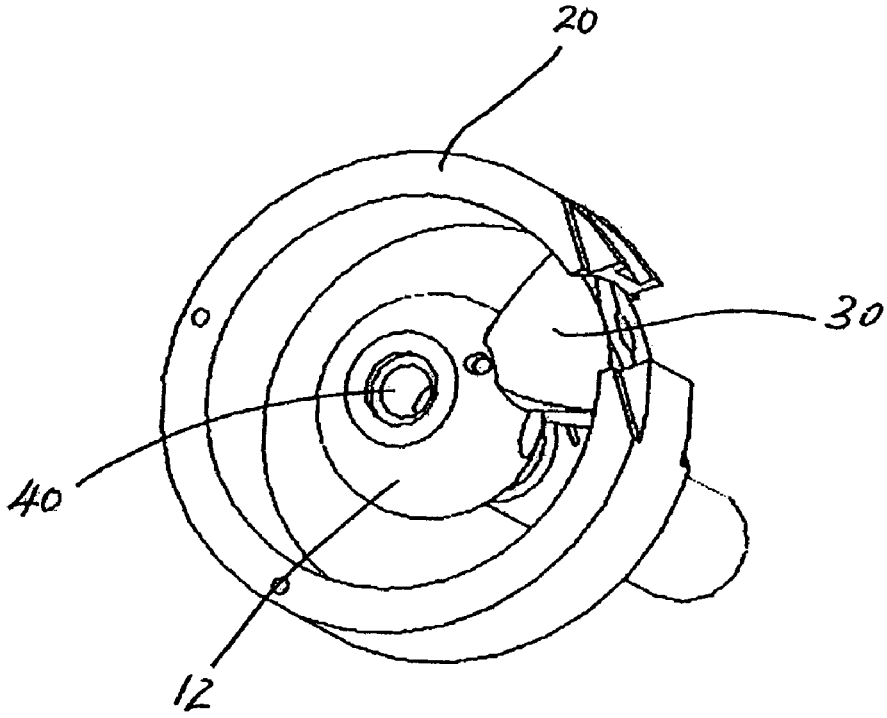
FIG. 13 is a front perspective view of the assembly of FIG. 12 showing the inlet port.
Figure 14:
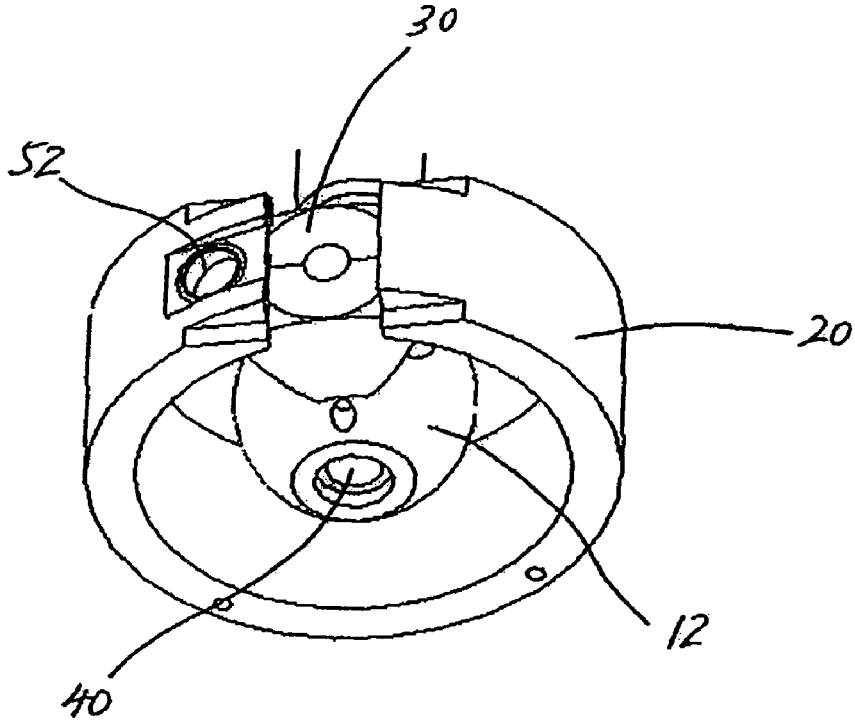
FIG. 14 is a front perspective view of the assembly of FIG. 12 showing the outlet port.
Figure 15:
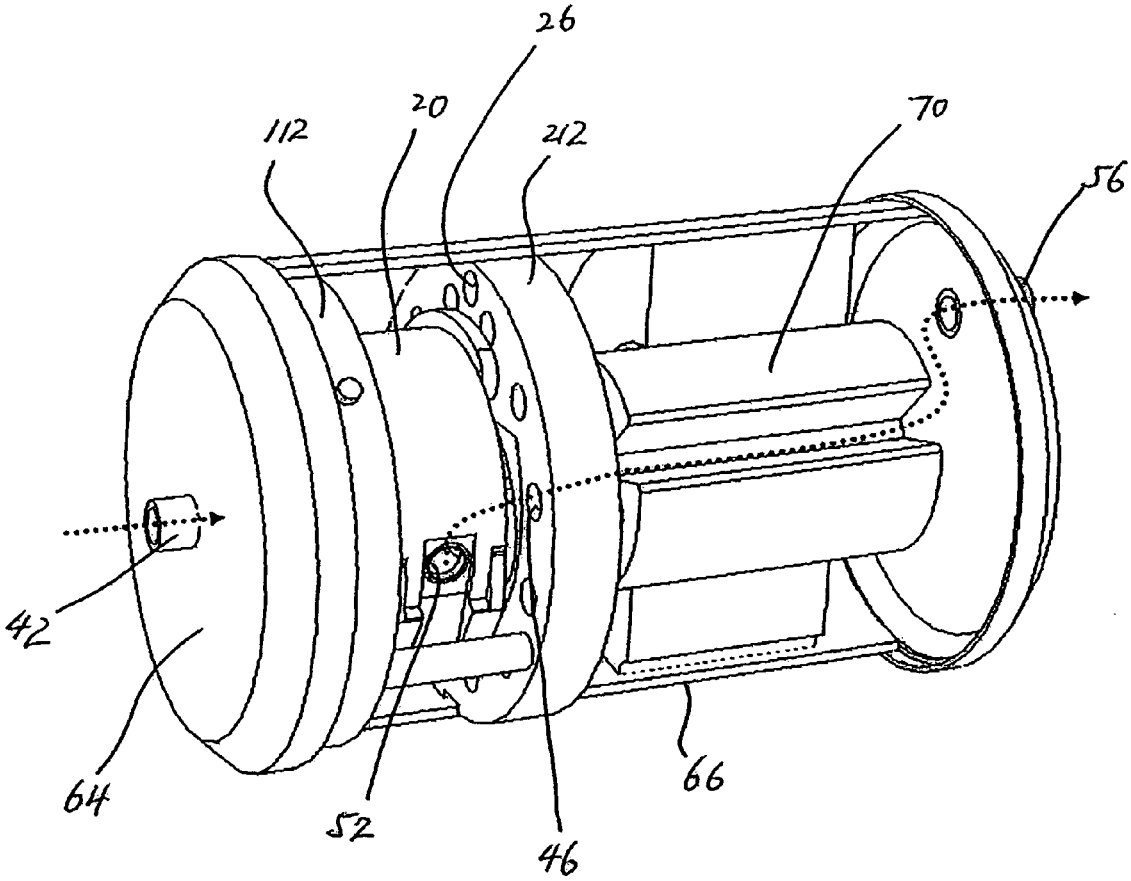
FIG. 15 is a perspective view in partial cut-away showing fluid paths.

Although the central sphere 12 is a complete sphere, it is not necessary to be so. As long as the spherical surface of central sphere 12 is large enough to effectively provide the inner seal, it serves its purpose. FIG. 7 illustrates a central sphere 12 that is a segment of a sphere and somewhat 'drum' shaped. The central sphere 12 may be relatively small to provide the effective sealing area. Also, the size of the central sphere 12 may also depend on the conical angle $\gamma$.

The outer-seal 20 provides an external hermetic seal for the working volume 16, thus making the working volume 16 an enclosed working chamber. The outer seal 20 has an inner surface 22 that is also shaped as a segment of a sphere with the outer surfaces 114, 214 respectively of plates 100, 200 being similarly shaped to provide a mating contact. The dimensions of the outer seal 20 depend on the conical angle of the plates 100, 200. A larger conical angle will require a taller outer seal to completely seal the working chamber.

Each plate 100, 200 has at least one outer groove 106, 206 respectively for lubricant distribution to the outer seal 20, as well be understood from the following description. At least one inner groove 108, 208 respectively is provided for lubricant distribution to central sphere 12.

The fluid block 30 is provided to effect change in the working volume 16 in order to enable compression/expansion of the working fluid. The fluid block 30 is located in conical or wedge-shaped cut-outs 122, 222 in the plates 100, 200 in a sealing manner with the plates 100, 200. The fluid block 30 is also conical in shape and has geometric matching with the surfaces of plates 100, 200 with which it is in contact.

The inclusion of the fluid block 30 interferes with the working chamber 16 in such a manner that it separates the working chamber 16 into two. The working chamber is now divided into one compression chamber and one suction chamber.

As the fluid block 30 is positioned directly in the path of motion of the two plates 100, 200, the fluid block 30 is in motion when the compressor 10 is operating. The fluid block 30 rotates with the two plates 100, 200 so that the motion of the fluid block 30 does not interfere with the rotation of the plates 100, 200. The contact between the fluid block 30 and the plates 100, 200 is a sealing engagement throughout the entire working cycle. The fluid block 30 rotates about a third axis of rotation 32. All three axes 102 and 202, 32 intersect at the centre of the central sphere 12. As such, the axis of rotation 32 of the fluid block 30 is also the symmetrical axis of the central sphere 12 and the outer seal 20. The plates 100, 200 will move laterally relative to the fluid block 30 during the rotation of the plates 100, 200. This is easily seen from FIGS. 18 to 29.

The three components, central seal 12, fluid block 30 and outer seal 20 are rigidly connected and to rotate about axis 32. A T-lock and pin (not shown) is used to connect the three components. However, any suitable connection may be used such as, for example, bolts. In consequence, the fluid block 30, outer seal 20, central sphere 12, and plates 100, 200, are in rotation about axes 32, 102 and 202 respectively.

The fluid block 30, outer seal 20 and central sphere 12 constitute a driver assembly. Preferably, the central sphere 12 is made as one piece with the driver shaft 80. Each plate 100, 200 has a bush 110, 210 respectively, for mounting the plates 100, 200 to bush supports 112, 212 respectively. Bush supports 112, 212 are joined by bolts 34 adjacent their periphery 26.

The operation of the compressor can be achieved by coupling the driver assembly (12, 20, 30) to the motor 70. As the fluid block 30 is in sealing and motion-inducing contact with the two plates 100, 200, the motion of the fluid block 30 'pushes' on both the plates 100, 200 causing them to rotate about their own axes of rotation. Due to a very low relative velocity between the components in contact, the sliding friction is minimal. A consequence of the motion is that the inlet port 40 and outlet port 50 are also rotating.

The inlet port 40 is operatively connected to and rotates with the central sphere 12 and has its longitudinal axis concentric with axis 32. Working fluid can be transferred from the inlet port 40 to the working chamber 16 via internal passageways 18 in central sphere 12.

An inlet pipe 42 is rigidly connected to casing front end 64 and is in sealing engagement with inlet port 40. The stationary inlet pipe 42 allows the transfer of the working fluid from other parts of the fluid circuit to the compressor 10.

The working fluid enters the compressor 10 through the inlet pipe 42 and inlet port 40 then flows through passageways 18 in the central sphere 12 to the working chamber 16. There may be any required number of passageways 18. The relative rolling action of the plates 100, 200, and the line contact 90, pushes the fluid around the working chamber 16 in a circular manner with the fluid block 30 separating the working chamber into the suction and the compression chambers. The suction chamber is immediately after the fluid block 30 and the compression chamber is immediately before the fluid block 30. Therefore, each chamber comprises approximately half of the rotational cycle of the plates 100, 200.

The working fluid is drawn into the compressor 10 by the expansion of the working volume 16. Also, and the centrifugal force acting on the rotating fluid causes it to be pushed outwards towards the periphery of the working chamber 16. As the entrance to the working chamber 16 is from the central sphere 12 and is located close to the rotational centre, more working fluid can therefore be drawn into the working chamber 16. This may be a form of pre-compression during the expansion phase, and may increase the volumetric efficiency of the compressor 10. To maximize this effect, the outlet port 50 is preferably near the periphery of the compressor 10.

The outlet port 50 is an opening 52 through the outer seal 20 for the compressed working fluid to exit from the compression chamber 16.

A valve (not shown) will be provided at the discharge port 50 to prevent backflow of the compressed working fluid. A deflection plate is commonly used as a valve to be fitted at the outlet port 50 to prevent backflow of the compressed working fluid. This is because the pressure inside the working chamber 16 will be lower than the discharge pressure during the initial phase of compression.

By locating the outlet port 50 in such a manner, the compressor 10 is housed in a hermetically enclosed chamber or outer casing 60. In this way the compressed working fluid is contained. The compressed working fluid will then be further discharged from the compressor 10 via discharge outlet 56 to other parts of the fluid circuit.

The outer casing 60 encloses the compressor unit 10 along with its motor 70 and is hermetically sealed and stationary. This prevents leakage of the working fluid from the compressor 10. As the compressor 10 and the motor 70 are connected, the whole interior of the outer casing 60 is subjected to discharge pressure. The outer casing 60 comprises two ends 62, 64 and a main body 66 that may be of any suitable or required shaped such as, for example, cylindrical, as shown.

The motor 70 may be any form or motor such as, for example, an electric motor as illustrated. The motor 70 is mounted within outer casing 60 and has an output shaft 72 that is operatively connected to or integral with drive shaft 80. Output shaft 72 passes through and is supported and held by a bearing 74 mounted on bush support 212. If desired or required, the motor 70 may be external of the outer casing 60.

The compressed working fluid from the outlet port 50 flows over the motor 70 for cooling purposes, and may flow through the motor stator. The bush support 212 has holes 46 to enable the compressed working fluid to pass therethrough in route to discharge outlet 56.

Lubrication is important as it helps to reduce friction and assists in preventing leakage of the working fluid.

Figure 16:
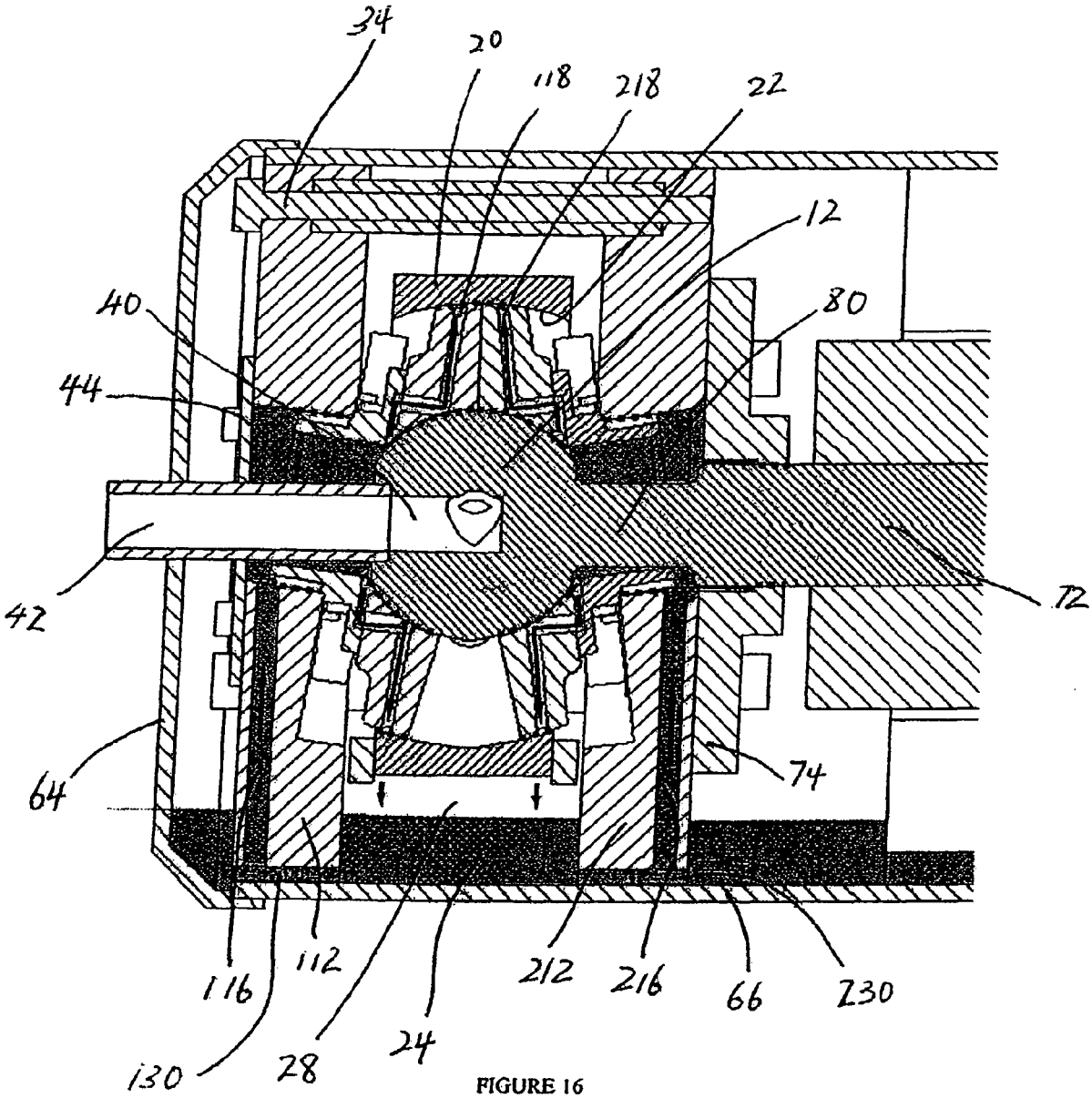
FIG. 16 is a vertical cross-sectional view of the compressor portion of FIG. 15.
Figure 17:
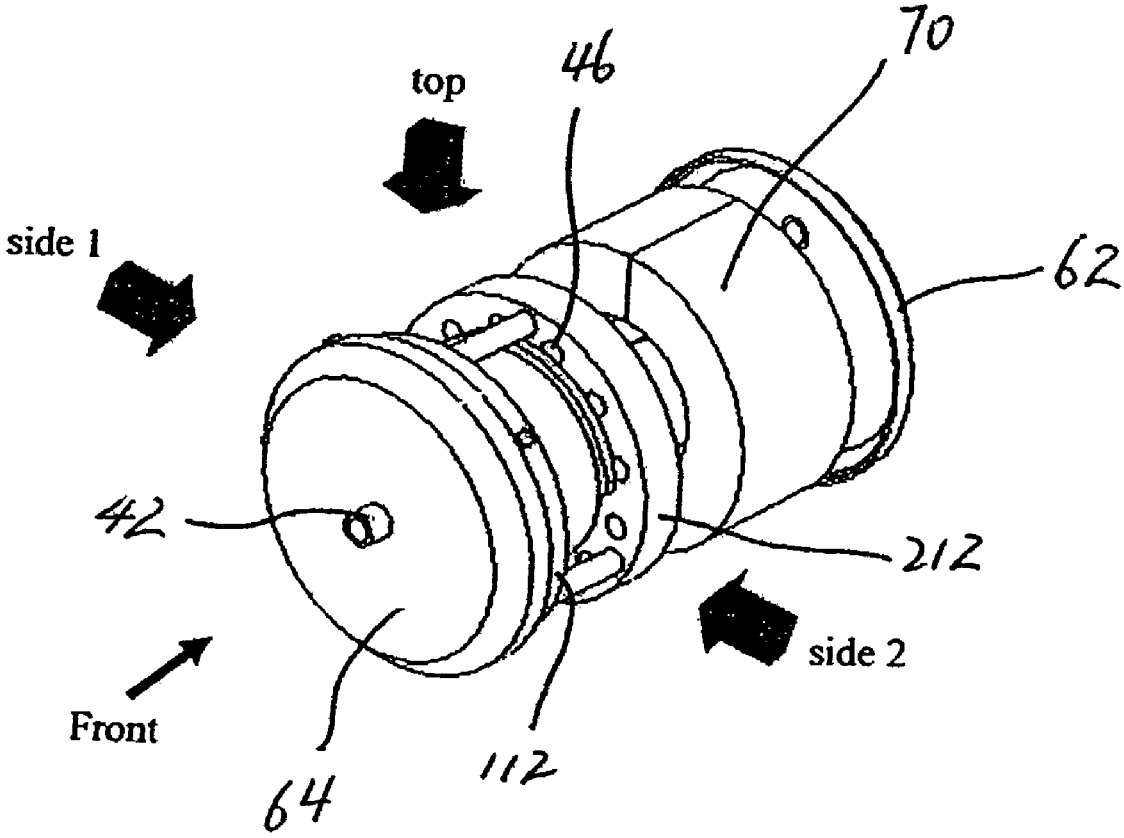
FIG. 17 is a perspective view of the assembly of FIG. 15 with directional arrows.

The compressor 10 is charged with lubricant 24 to a required level as shown in FIG. 16. The lubricant 24 locates in outer casing 60 and can circulate due to the slots 130, 230 in bush supports 112, 212 respectively. The space between the bush supports 112, 212 also has lubricant 24.

The bush supports 112, 212 have lubricant passageways 116, 216 respectively to allow lubricant to pass to:

(a) bushes 110, 210;

(b) drive shaft 80;

(c) output shaft 72 and bearing 74;

(d) central sphere 12; and (e) through lubricant passageways 118, 218 in plates 100, 200 respectively to grooves 106, 206 to lubricate the contact between outer surfaces 114, 214 and the inner surface 22 of outer seal 20.

Preferably, the working fluid and the lubricant 24 are immiscible. Otherwise, an oil separator (not shown) may be required downstream from discharge outlet 56.

Such a system causes all rotational contacts to be exposed to the lubricant, thereby achieving lubrication. The contact areas between the two plates 100, 200, the central sphere 12, the outer seal 20 and the fluid block 30, will also be lubricated during operation.

Due to the spinning of the main operational components of compressor 10, the centrifugal force causes some of the lubricant 24 to be drawn towards the contact surfaces. Excessive lubricant may flow out of the compressor 10 and back to the lubricant reservoir 28, ready to be circulated again. This circulation of lubricant 24 is possible as the entire housing 60 interior is maintained at discharge pressure during the operation of compressor 10.

FIGS. 17 to 29 depict the working cycle of the compressor at 90° intervals. To effectively enable understanding of the compressor's operation, three views of the compressor 10 at various positions were taken at 90° intervals. The outer seal 20 is removed for clarity. However, for illustration purposes, a floating circle representing the outlet port 50 is included. Note that the compressor 10 is rotating in the anticlockwise direction when viewed from the front.

In this embodiment, the rolling line contact 90 is stationary relative to the casing 60. As shown, the rolling line contact 90 is at the top. However, it can be in any suitable location depending on the orientation of the rotational axes 102, 202.

Figure 18:
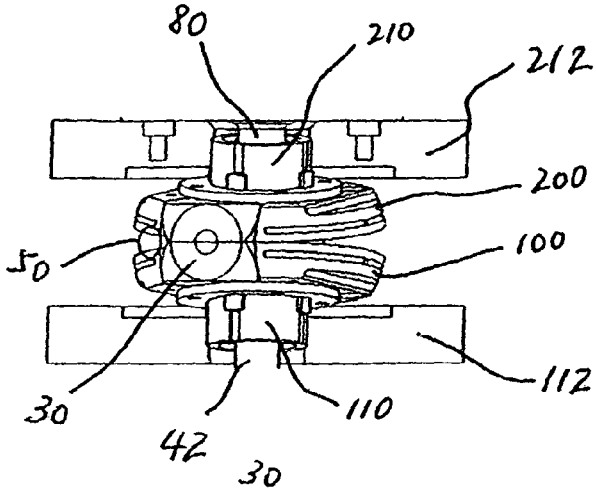
FIG. 18 is a partial view of the assembly of FIG. 17 from the top at 0° of rotation.
Figure 19:
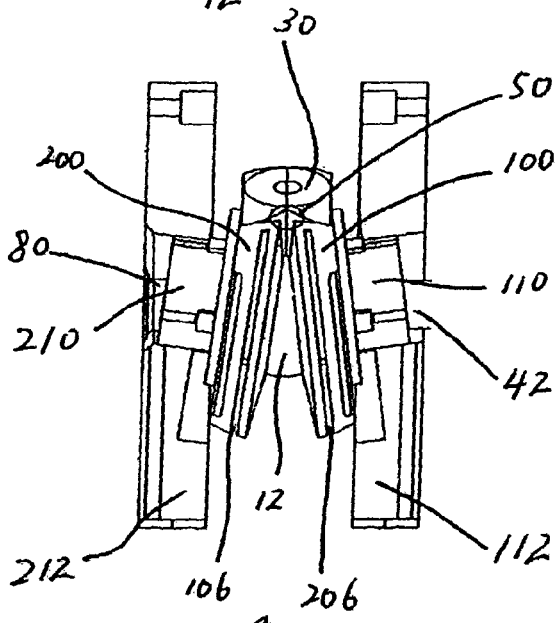
FIG. 19 is a partial view of the assembly of FIG. 17 from side 1 at 0° of rotation.
Figure 20:
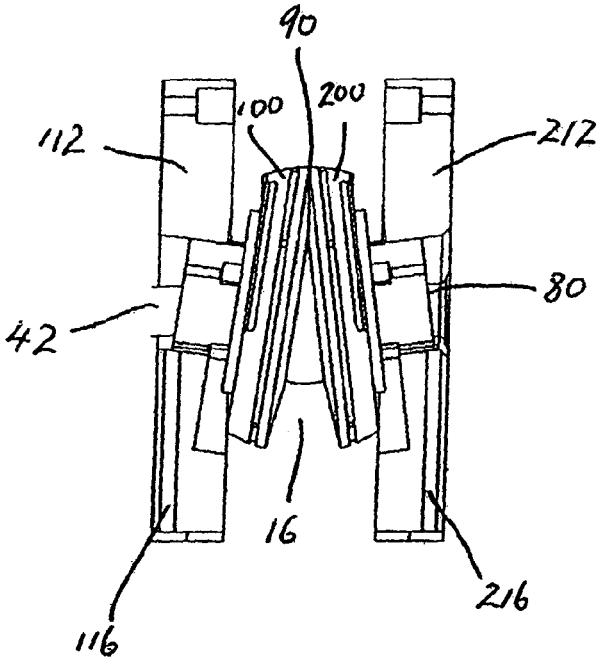
FIG. 20 is a partial view of the assembly of FIG. 17 from side 2 at 0° of rotation.
Figure 21:
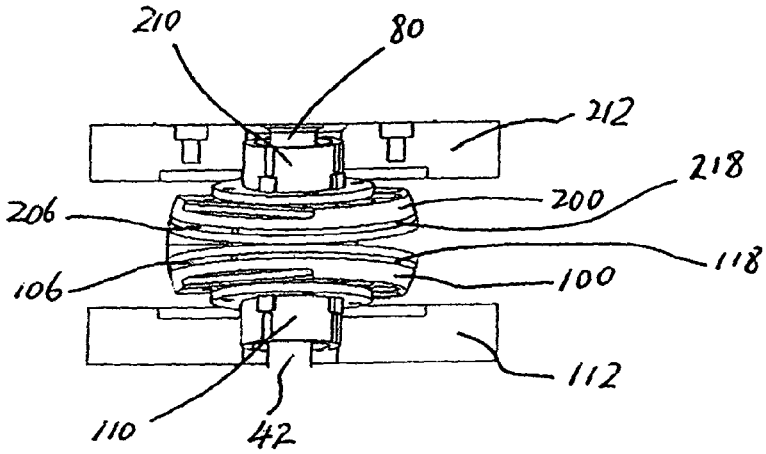
FIG. 21 is a partial view of the assembly of FIG. 17 from the top at 90° of rotation.
Figure 22:
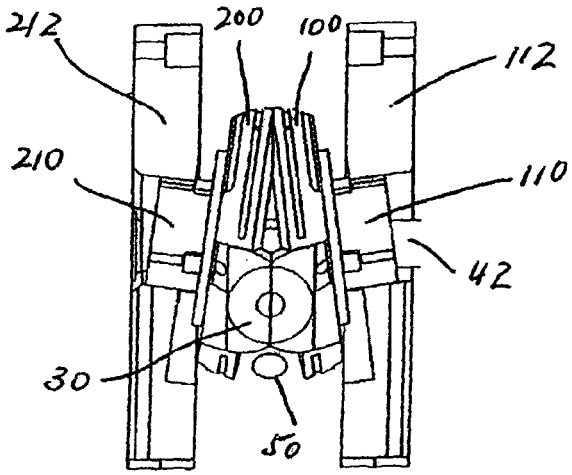
FIG. 22 is a partial view of the assembly of FIG. 17 from side 1 at 90° of rotation.
Figure 23:
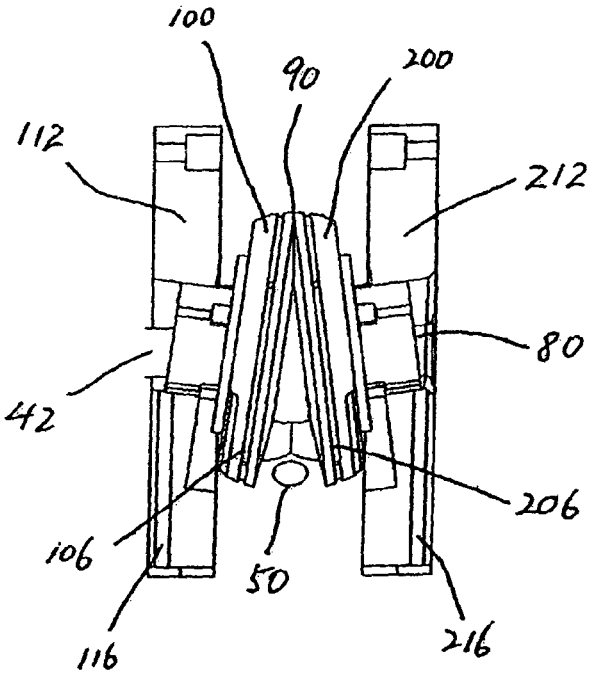
FIG. 23 is a partial view of the assembly of FIG. 17 from side 2 at 90° of rotation.
Figure 24:
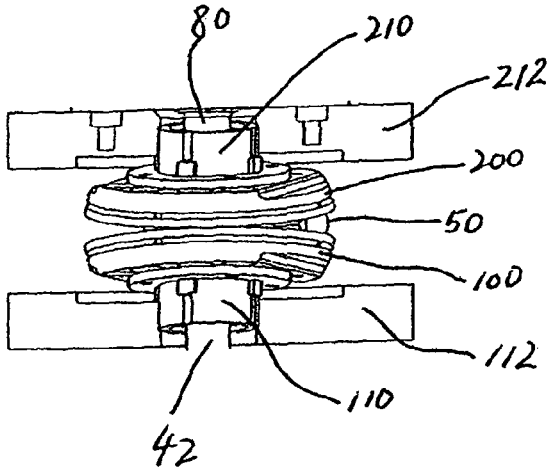
FIG. 24 is a partial view of the assembly of FIG. 17 from the top at 180° of rotation.
Figure 25:
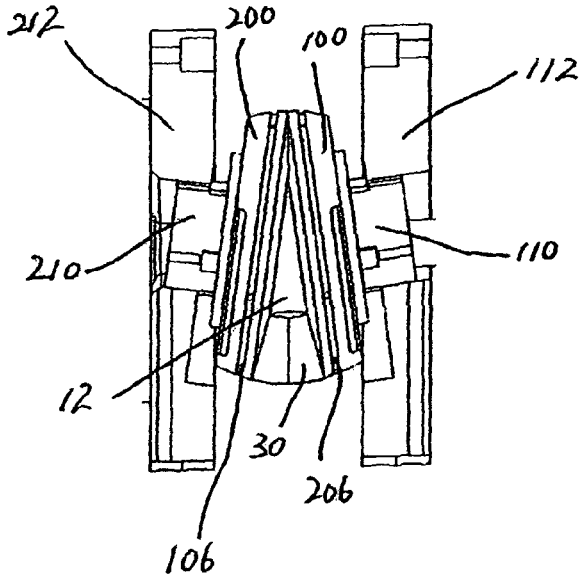
FIG. 25 is a partial view of the assembly of FIG. 17 from side 1 at 180° of rotation.
Figure 26:
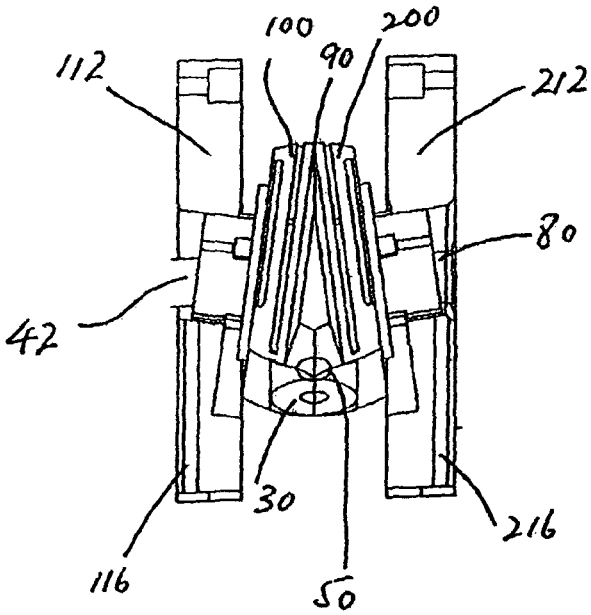
FIG. 26 is a partial view of the assembly of FIG. 17 from side 2 at 180° of rotation.
Figure 27:
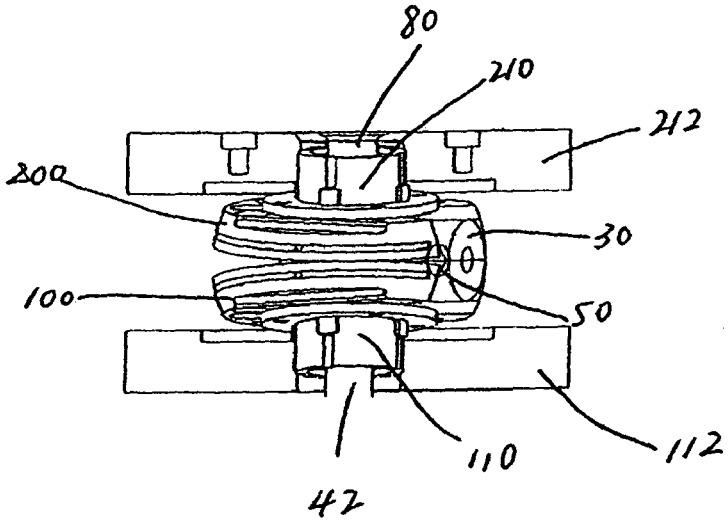
FIG. 27 is a partial view of the assembly of FIG. 17 from the top of 270° of rotation.
Figure 28:
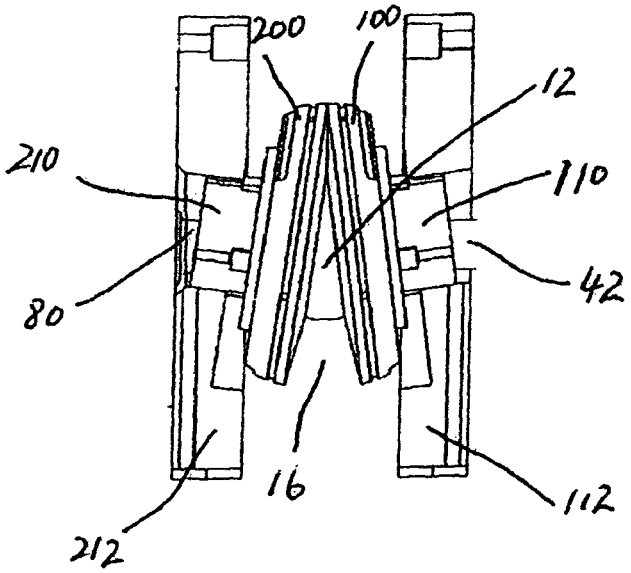
FIG. 28 is a partial view of the assembly of FIG. 17 from side 1 at 270° of rotation.
Figure 29:
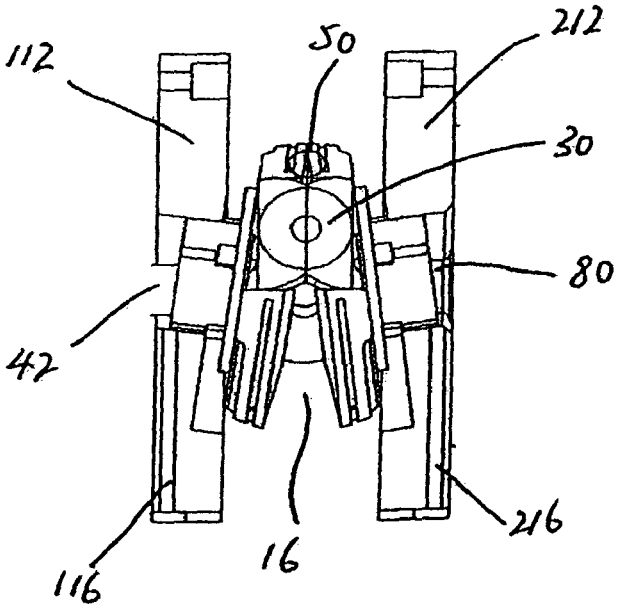
FIG. 29 is a partial view of the assembly of FIG. 17 from side 2 at 270° of rotation.

FIGS. 18 to 20 show the beginning of the expansion portion of the cycle as the line contact 90 is just after the fluid block 30, thus minimizing the expansion chamber of the working volume. On the other side of the fluid block 30 the compression portion of the previous cycle had commenced. FIGS. 21 to 23 show the commencement of the expansion portion of the cycle where fluid is drawn into the working chamber 16. Compression of the previous cycle continues and discharge of the working fluid is initiated once the chamber pressure exceeds the discharge pressure. Expansion and compression/discharge continues in FIGS. 24 to 26. In FIGS. 27 to 29 compression of the previous cycle approaches its completion and the compression chamber approaches its minimum. The expansion chamber also approaches its maximum, where the working fluid drawn in will undergo compression in the next cycle.

The conical plate 100 may be held stationary relative to the casing 60 with only conical plate 200 moving relative to plate 100 in a rotational rolling motion. This will therefore also be a motion relative to casing 60. In this way the line contact 90 will be maintained as before, but will rotate relative to plate 100 and thus casing 60 at the same speed as the rolling motion of plate 200. For such an embodiment, the fluid block 30 will be fixed to plate 100 and motor 70 will drive plate 200 only, all other components being fixed.

Figure 30:
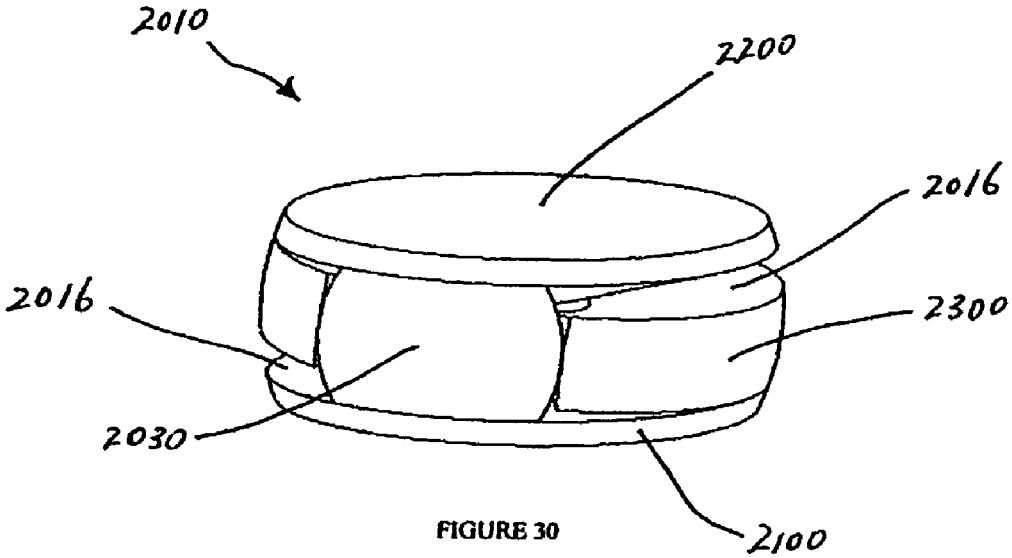
FIG. 30 is a schematic partial front perspective view of a second embodiment.
Figure 31:
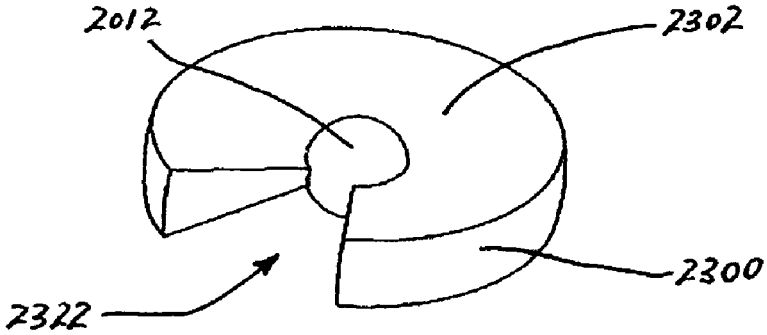
FIG. 31 is a front perspective view of the centre plate and central seal of the embodiment of FIG. 30.
Figure 32:
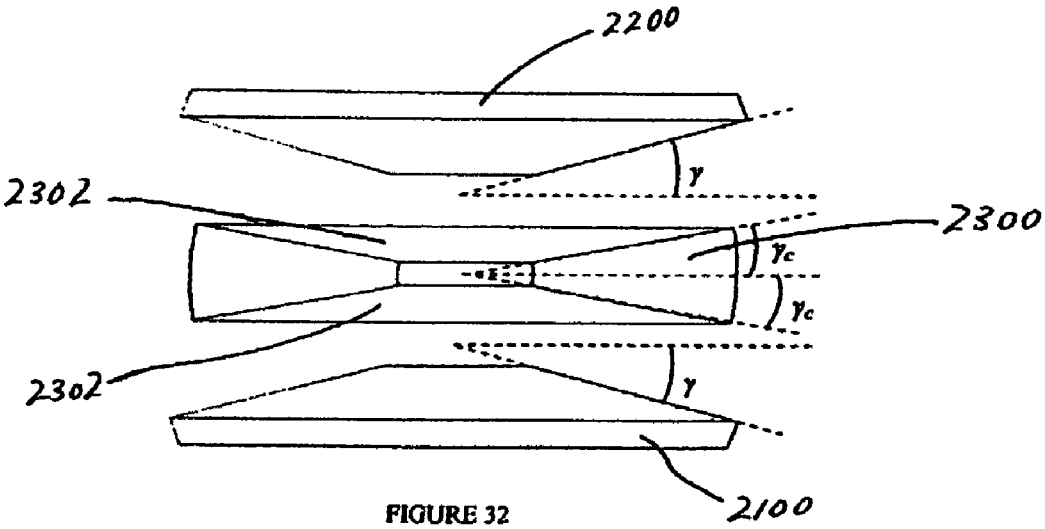
FIG. 32 is a schematic exploded side view of the three plates of FIG. 30.

FIG. 30 shows a further embodiment where the same reference numerals are used with a prefix number 2. The embodiment is a double-volume compressor 2010. The primary differences are that the first plate 2100 and the second plate 2200 are both fixed relative to casing 60, and the addition of a centre plate 2300. However, the motion principle remains unchanged. FIG. 30 shows the double-volume compressor without the casing 60 or any drive system. The centre plate 2300 is located between the two plates 2100, 2200 and forms a line contact 2090 with each of the plates 2100, 2200. In this instance, plates 2100, 2200 are identical. In consequence, there is a working volume 2016 between plate 2100 and plate 2300, and between plate 2200 and plate 2300. The centre plate 2300 moves about the common spherical central seal 2012 and thereby changes the two working volumes achieving expansion and compression of the working fluid.

In order to be able to form the line contact 2090 with plates 2100, 2200, the centre plate 2300 has two surfaces 2302 one of which is in contact with plate 2100 and the other of which is in contact with plate 2200. The surfaces 2302 are concave and conical. In order to create a working volume 2016, the conical angle $\gamma_c$ of the centre plate 2300 is smaller than the conical angle $\gamma$ of the fixed plates 2100, 2200. The two working volumes 2016 only exist if $\gamma > \gamma_c$.

Although there is symmetry of the components relative to the horizontal plane cutting through the centre seal as observed in FIGS. 30 to 34, this is not essential provided the difference between the conical angles $\gamma$ concerning each working volume 2016 is the same:

$$\gamma_c - \gamma\ [\text{upper}] = \gamma_c - \gamma\ [\text{lower}]$$

where upper and lower denotes the two sets of conical angles for each working volume respectively.

Figure 33:
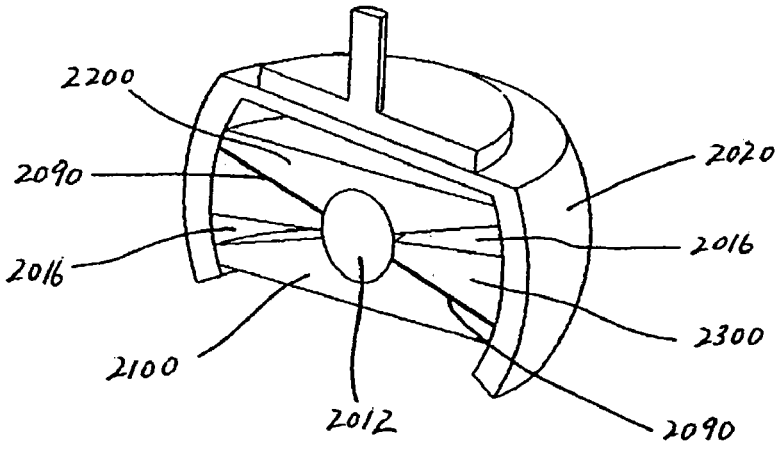
FIG. 33 is a perspective cross-sectional view of the embodiment of FIG. 30.
Figure 34:
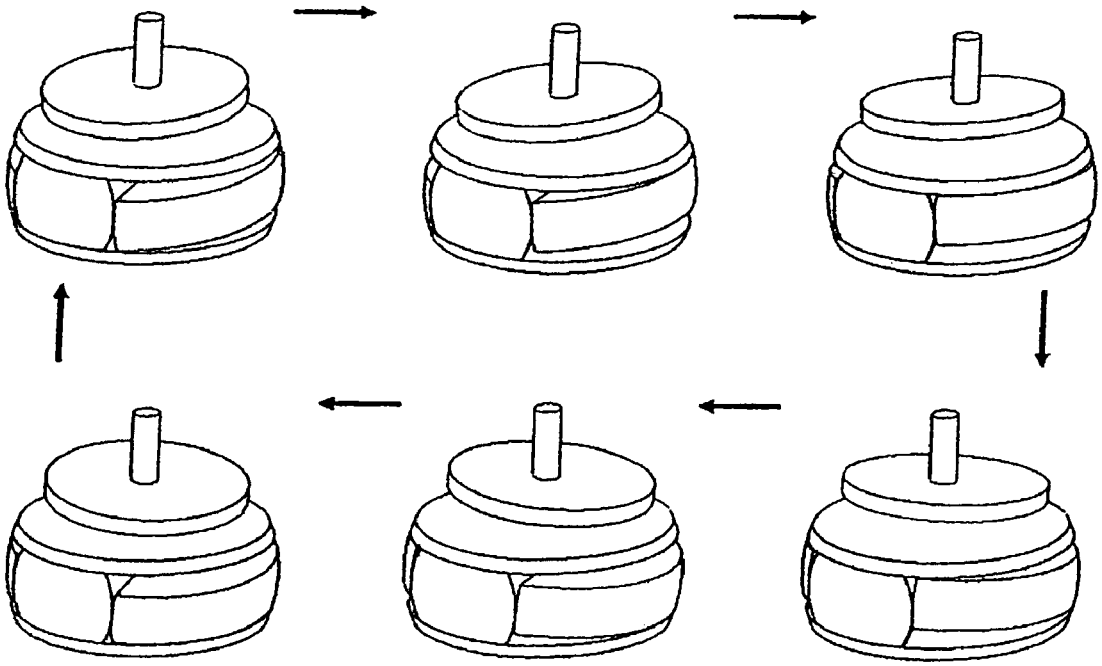
FIG. 34 is a series of perspective views of the embodiment of FIGS. 30 to 33 during rotation, with the outer seal hidden.

FIG. 33 shows an illustration of the complete compressor of this embodiment. Unlike the earlier embodiments, the outer seal 2020 is connected to the moving centre plate 2300 and therefore would also be moving. The motor 70 will drive the outer seal 2020 that in turn causes the centre plate 2300 to execute the desired motion.

As the outer seal 2020 is in motion the fixture or grounding of the compressor can only be done via the bottom fixed plate 2100. A large conical angle $\gamma$ for the bottom plate 2100 is therefore undesirable as it would mean a reduced surface area on the base of the component for a mounting.

Two-stage compression may be used by connecting the two working volumes 2016.

Naturally, the compressor 10 may be used as a motor. In this case the inlet port 40 would be the fuel inlet; outlet port 50 the exhaust; and motor 70 would be the "load". It may also be used as a conventional pump.

Whilst there has been described in the foregoing description preferred embodiments of the present invention, it will be understood by those skilled in the technology concerned that many variations or modifications in details of design or construction may be made without departing from the present invention.

The invention claimed is:

1. A rotary, twin-plate compressor comprising:

(a) two conical plates for plates for relative rolling motion within a casing, there being a line contact between the two conical plates;

(b) the line contact being maintainable during operation of the compressor;

(c) a central seat for sealingly engaging correspondingly-shaped recesses of the two conical plates; and (d) an outer seal in mating relationship with the two conical plates;

wherein the central seal is mounted on a drive shaft, the drive shaft being operatively connected to an output shaft of a motor;

wherein the drive shaft, the central seal and the outer seal are for rotation about a third axis of rotation, the third axis of rotation being coincident with a longitudinal axis of the drive shaft and a center of the central seal.

2. The compressor as claimed in claim 1, wherein the line contact is able to be maintained throughout the operational cycle of the compressor.

3. The compressor as claimed in claim 1, wherein the line contact is maintained at a relative to the casing that is selected from the group consisting of: fixed, and rotating.

4. The compressor as claimed in claim 1, wherein the central seal is substantially spherical.

5. The compressor as claimed in claim 1 further comprising an inlet port in the central seal, the central seal having at least one fluid passageway to operatively connect the inlet port to a working chamber.

6. The compressor as claimed in claim 5, wherein the outer seal comprises an outlet port on an outer surface of the outer seal, the outlet port being an opening through the outer seal.

7. The compressor as claimed in claim 1, wherein the outer seal comprises an inner surface shaped as a segment of a sphere, each of the two conical plates having an outer surface of a shape to mate with the inner surface.

8. The compressor as claimed in claim 1, further comprising a fluid block in sealing engagement with the two conical plates and being for rotation in therewith.

9. The compressor as claimed in claim 8, wherein the fluid block is connected to the central seal and the outer seal.

10. The compressor as claimed in claim 8, wherein a working chamber is an enclosed space defined by the central seal, the two conical plates, the fluid block and the outer seal.

11. The compressor as claimed in claim 8, wherein the drive shaft, the fluid block, the central seal and the outer seal are for rotation about the third axis of rotation.

12. The compressor as claimed in claim 8, wherein the central seal, the outer seal and the fluid block comprise a drive assembly.

13. The compressor as claimed in claim 1, wherein the two conical plates comprise a first plate having a first axis of rotation and a second plate having a second axis of rotation, the first axis of rotation being offset at an offset angle relative to the second axis of rotation.

14. The compressor as claimed in claim 13, wherein the offset angle is selected from the group consisting of: in the range 1 to 90 degrees, less than 45 degrees, less than 20 degrees, and about 7.5 degrees.

15. The compressor as claimed in claim 13, wherein the two conical plates each comprises a conical angle, the conical angles determining the offset angle.

16. The compressor as claimed in claim 1, wherein the casing is hermetically sealed and comprises a hollow main body, and an end plate at each end of the hollow main body.

17. The compressor as claimed in claim 16 further comprising a discharge outlet in one of the end plates, the hollow main body having an interior at discharge pressure.

18. The compressor as claimed in claim 1, wherein each of the two conical plates is mounted on a bush, each bush being mounted on a bush support.

19. The compressor as claimed in claim 18, further comprising lubricant passageways in the bush supports and the two conical plates.

20. A motor comprising the compressor as claimed in claim 1.

21. A rotary twin-plate compressor comprising:

(a) a first conical plate having a first axis of rotation, and (b) a second conical plate having a second axis of rotation;

(c) the first axis of rotation being offset at an offset angle relative to the second axis of rotation;

(d) a central seal for sealingly engaging correspondingly-shaped recesses of the first and second conical plates;

(e) an outer seal in mating relationship with the first and second conical plates;

wherein the central seal is mounted on a drive shaft, the drive shaft being operatively connected to an output shaft of a motor;

wherein the drive shaft, the central seal and the outer seal are for rotation about a third axis of rotation, the third axis of rotation being coincident with a longitudinal axis of the drive shaft and a center of the central seal.

22. A compressor as claimed in claim 21, wherein the first conical plate and the second conical plate are for rolling relative to each other within a casing, there being a line contact between the two conical plates; and the line contact being maintained at a position relative to the casing that is selected from the group consisting of: fixed, and rotating.

23. The compressor as claimed in claim 22, wherein the first plate is stationary relative to the casing, and the second plate has motion relative to the casing, the line contact rotating relative to the casing.

24. The compressor as claimed in claim 21, wherein the central seal is substantially spherical.

25. The compressor as claimed in claim 21, further comprising an inlet port in the central seal, the central seal having at least one fluid passageway to operatively connect the inlet port to a working chamber.

26. The compressor as claimed in claim 21, wherein the outer seal comprises an inner surface shaped as a segment of a sphere, each of the two conical plates having an outer surface of a shape to mate with the inner surface.

27. The compressor as claimed in claim 21, wherein the outer seal comprises an outlet port on an outer surface of the outer seal, the outlet port being an opening through the outer seal.

28. The compressor as claimed in claim 21, further comprising a fluid block in sealing engagement with the first and second conical plates and being for rotation in therewith.

29. The compressor as claimed in claim 28, wherein the fluid block is connected to the outer seal and the central seal.

30. The compressor as claimed in claim 28, wherein the working chamber is an enclosed space defined by the central seal, the two conical plates, the fluid block and the outer seal.

31. The compressor as claimed in claim 28, wherein the drive shaft, central seal, the fluid block and the outer seal are for rotation about the third axis of rotation.

32. The compressor as claimed in claim 28, wherein the central seal, the outer seal and the fluid block comprise a driver assembly.

33. The compressor as claimed in claim 21, wherein the offset angle is selected from the group consisting of: in the range 1 to 90 degrees, less than 45 degrees, less than 20 degrees, and about 7.5 degrees.

34. The compressor as claimed in claim 21, wherein the two conical plates each comprises a conical angle, the conical angles determining the offset angle.

35. The compressor as claimed in claim 21, wherein the casing is hermetically sealed and comprises a hollow main body, and an end plate at each end of the hollow main body.

36. The compressor as claimed in claim 35, further comprising a discharge outlet in one of the end plates, the hollow main body having an interior at discharge pressure.

37. The compressor as claimed in claim 21, wherein each of the first and second conical plates is mounted on a bush, each bush being mounted on a bush support.

38. The compressor as claimed in claim 37, further comprising lubricant passageways in the bush supports and the first and second conical plates.

39. The compressor as claimed in claim 21, further comprising a third plate located between the first and second plates, the third plate comprising two surfaces, one of which forms a first line contact with the first plate and the other of which forms a second line contact with the second plate; the first and second plates being stationary and the third plate being for a rolling motion relative to both the first and second plates.

40. The compressor as claimed in claim 39, wherein both of the two surfaces of the third plate are concave and conical; the conical surfaces of the third plate having a conical angle different to that of the first plate and that of the second plate.

41. The compressor as claimed in claim 39, wherein the outer seal moves in rolling motion with the third plate.

42. A motor comprising the compressor as claimed in claim 21.

* * * * *

UNITED STATES PATENT AND TRADEMARK OFFICE

CERTIFICATE OF CORRECTION

PATENT NO. : 7,726,960 B2
APPLICATION NO. : 11/628440
DATED : June 1, 2010
INVENTOR(S) : Ooi et al.

It is certified that error appears in the above-identified patent and that said Letters Patent is hereby corrected as shown below:

The "Inventors" section on the patent's front page should read as follows:

Kim Tiow Ooi, Singapore (SG); Yong Liang Teh, Singapore (SG)

Signed and Sealed this

Fifth Day of October, 2010

David J. Kappos

David J. Kappos
*Director of the United States Patent and Trademark Office*